US009160052B2

(12) United States Patent
Tesson et al.

(10) Patent No.: US 9,160,052 B2
(45) Date of Patent: Oct. 13, 2015

(54) LANGE COUPLER AND FABRICATION METHOD

(71) Applicant: NXP B.V., Eindhoven (NL)

(72) Inventors: Olivier Tesson, Bretteville l'Orgueilleuse (FR); Patrice Gamand, Douvres la Delivrande (FR); Sidina Wane, Caen (FR)

(73) Assignee: NXP, B.V., Eindhoven (NL)

( * ) Notice: Subject to any disclaimer, the term of this patent is extended or adjusted under 35 U.S.C. 154(b) by 221 days.

(21) Appl. No.: 13/781,564

(22) Filed: Feb. 28, 2013

(65) Prior Publication Data

US 2013/0229239 A1 Sep. 5, 2013

(30) Foreign Application Priority Data

Mar. 1, 2012 (EP) ..... 12290071

(51) Int. Cl.
*H01P 5/18* (2006.01)

(52) U.S. Cl.
CPC ..... *H01P 5/186* (2013.01)

(58) Field of Classification Search
CPC ..... H01P 5/185; H01P 5/186
USPC ..... 333/116
See application file for complete search history.

(56) References Cited

U.S. PATENT DOCUMENTS 5,446,425 A 8/1995 Banba
5,629,654 A 5/1997 Frick
7,119,633 B2 * 10/2006 Stoneham ..... 333/116
2002/0149441 A1 10/2002 Catoiu
2006/0044073 A1 3/2006 Stoneham
2010/0231322 A1 9/2010 Ding et al.

OTHER PUBLICATIONS

Lange, J. "Interdigitated Strip-Line Quadrature Hybrid" G-MTT International Microwave Symposium, pp. 10-13 (1969).

Seo, S. et al. "A Wideband Balanced AlGaN/GaN HEMT MMIC Low Noise Amplifier for Transceiver Front-ends", Gallium Arsenide and Other Semiconductor Application Symposium, pp. 225-228 (Oct. 2005).

Wang, L. et al. "Lange Coupler Design for Si-ICs up to 170GHz in 0.13um SiGe BiCMOS", IEEE International Symposium on Radio-Frequency Integration Technology, pp. 64-27 (Oct. 2009).

Carchon, G. et al. "Design of CPW Lange Couplers in Multi-Layer Thin-Film MCM-D" IEEE 30$^{th}$ European Microwave Conference, pp. 1-4 (Oct. 2000).

Karkkainen, M. et al. "Transmission Line and Lange Coupler Implementations in CMOS", Proceedings of the 5$^{th}$ European Microwave Integrated Circuits Conference, pp. 357-360 (2010).

Extended European Search Report for Patent Appln. No. 12290071.5 (Jul. 30, 2012).

Thomas H. Lee, Planar Microwave Engineering, Cambridge University Press, 2004, ISBN 0521835267 (partial copy provided).

* cited by examiner

*Primary Examiner* — Sibin Chen
*Assistant Examiner* — Metasebia Retebo

(57) ABSTRACT

A Lange coupler comprises an unbroken peripheral ground conductor surrounding input, through, coupled and isolated conductor strips coupled to input, through, coupled and isolated ports of the Lange coupler respectively, wherein the peripheral ground conductor and input and through conductor strips are arranged on a first metal layer.

16 Claims, 5 Drawing Sheets

LANGE COUPLER AND FABRICATION METHOD

CROSS-REFERENCE TO RELATED APPLICATIONS

Figure 1:
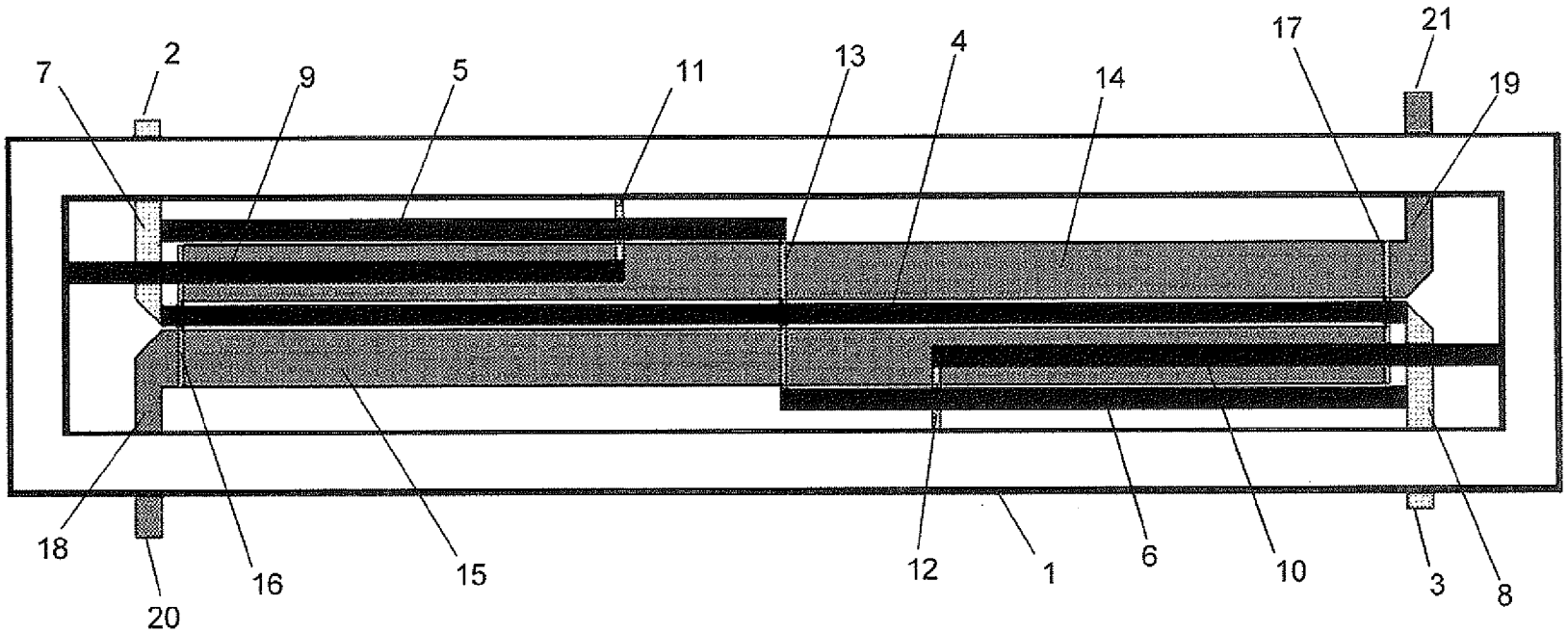

This application claims the priority under 35 U.S.C. §119 of European patent application no. 12290071.5, filed on Mar. 1, 2012, the contents of which are incorporated by reference herein.

The invention relates to a Lange coupler and to a method of fabricating a Lange coupler.

In high frequency applications, circuit designs often involve a combination of analogue and microwave design techniques, potentially incorporating transmission lines, splitters and couplers. For example, 90° and 180° hybrid couplers are useful for quadrature or differential local oscillators, balanced amplifier designs, various mixer topologies and baluns.

Hybrid couplers are four port devices that have a matched impedance at all ports, at least one isolated output port (i.e. one that produces zero output at certain input conditions), and provide equal power division. The Lange coupler introduced by Julius Lange in 1969 is a commonly used type of Hybrid coupler. It is a microstrip coupler with an even number of interdigitated parallel strip lines with alternate lines tied together. A single ground plane, a single dielectric, and a single layer of metallization are used. The four ports of the Lange coupler are known as input, coupled, isolated and through ports. Thus, this approach is well suited for monolithic or hybrid, thin film, microwave integrated circuits.

The length of the interdigitated strip lines is chosen to be equal to a quarter of the wavelength of operation in order to produce a 90° phase shift between input and through ports. The conventional Lange coupler has cross-connections at the midpoint of the interdigitated strip lines. Usually, they are made of bond wires in case of low temperature co-fired ceramic (LTCC) and laminate processes, and with the help of vias and metallisation layers in the case of integrated circuit (IC) processes.

The key parameters for the Lange coupler are the voltage coupling coefficient C and the even and odd mode characteristic impedances ($Z_{oe}$, $Z_{oo}$). A challenge for Lange coupler design in IC technology is achieving a high voltage coupling coefficient and high characteristic impedances while satisfying the IC process design rules. In order to obtain the desired characteristics for a Lange coupler, the characteristic impedance of two coupled microstrip lines must be known very precisely. The values of both the inductance and capacitance are of course correlated to the geometrical aspects such as width and length of the microstrip lines. However, the crucial point is the position of the ground plane relative to the coupled microstrip lines because its effect on the inductive and the capacitive contributions is extremely significant.

In classical microwave device fabrication processes (e.g. LTCC and laminate processes), the ground plane is formed from a plate of metal and the average distance between the microstrip lines and the ground plane is very well controlled, generally in the order of 1 or 2 tenths of a mil (0.00254 mm to 0.00508 mm).

In microwave IC processes, two options have been available to ensure a good electrical ground. In the first option, the first level of metallisation of the IC process is used to create a ground plane. In conventional IC processes this results in the separation between the ground plane and strip lines of the Lange coupler being equal to several microns. In order to achieve the desired level of impedance for $Z_{oo}$ and $Z_{oe}$, this separation leads to Lange coupler dimensions (strip line width and spacing) that often are not compliant with the IC process design rules and/or narrow strip lines, which results in higher losses. In other words, the close proximity of the top metal layer used for the strip lines to the ground plane necessitates a small gap between the strip lines that often does not comply with the IC process design rules.

In the second option, the reverse of the die is used as a ground plane. However, this requires that the wafer is first ground down to the correct thickness and that its reverse is metallised. These additional steps result in an increase in cost. Another drawback can arise if the die needs to be flipped to suit the application. The reverse metallisation is then not connected to ground and the Lange coupler is not referenced correctly to ground and loses its efficiency.

According to the invention, there is provided a Lange coupler comprising input and through conductor strips coupled respectively to input and through ports of the Lange coupler, and an unbroken peripheral ground conductor surrounding the input and through conductor strips, the peripheral ground conductor and input and through conductor strips being arranged on a first metal layer.

By surrounding the input and through conductors with an unbroken peripheral ground conductor, a mainly co-planar mode of signal propagation (from the input port to the through port) is made possible and the invention can be implemented without a ground plane. Thus, the cost involved with grinding the die and using the reverse metallisation layer is no longer incurred and the grounding arrangement is compatible with any packaging configuration, including flip-chip configurations. Furthermore, a Lange coupler can be straightforwardly designed to meet the necessary performance requirements whilst being compliant with IC process design rules. The problems associated with the prior art discussed above are therefore overcome.

In a preferred embodiment, the input and through conductor strips together comprise a central conductor and a pair of outer conductors, the central conductor being coupled to one of the pair of outer conductors at each end and to each of the outer conductors at a midpoint along its length. The central and output conductors can be spaced apart by a suitable distance to allow them to lie either side of coupled and isolated conductor strips of the Lange coupler, which are normally arranged on a different metal layer to the first metal layer.

Preferably, the Lange coupler further comprises first and second ground conductor strips coupled to the ground conductor at each end and interposed between the central conductor and a respective one of the pair of outer conductors. The first and second ground conductor strips act as ground conductors in a microstrip arrangement for other conductors, such as coupled and isolated conductor strips of the Lange coupler, arranged on a different metal layer to the first metal layer. When arranged in this way, the Lange coupler operates in two propagation modes: a coplanar wave guide mode for the input and through conductor strips and a microstrip mode for the coupled and isolated conductor strips.

The central conductor may be coupled to the pair of outer conductors at its end and at its midpoint by respective bridging links on another metal layer different from the first layer.

The input and through conductor strips are typically coupled to the input and through ports by respective conducting links on the other metal layer.

When present, each of the first and second ground conductor strips typically has a free end coupled to the ground conductor by a conducting link on the other metal layer.

Preferably, the coupled and isolated conductor strips are arranged on a second metal layer. This second metal layer thus corresponds to the different metal layer referred to above on which the coupled and isolated conductor strips are normally arranged. When the central and outer conductors forming the input and through conductor strips are suitably spaced, as discussed above, the coupled and isolated conductor strips thus effectively interdigitate (albeit across different metal layers) with the input and through conductor strips. The first and second ground conductor strips are preferably arranged in vertical alignment with the coupled and isolated conductor strips.

The other metal layer is typically an intermediate metal layer lying between the first and second metal layers. However, in other embodiments, it may be a metal layer lying beneath both the first and second metal layers or above both the first and second metal layers.

In accordance with a second aspect of the invention, there is provided a semiconductor substrate comprising a Lange coupler according to the first aspect of the invention.

The first, intermediate and second metal layers of the Lange coupler referred to above are typically top, intermediate and bottom metallisation layers of the semiconductor substrate.

In accordance with a third aspect of the invention, there is provided a method of fabricating a Lange coupler, the method comprising forming, on a first metal layer, input and through conductor strips and an unbroken peripheral ground conductor surrounding the input and through conductor strips.

The method typically further comprises forming coupled and isolated conducting strips on a second metal layer.

In this case, the method preferably further comprises forming first and second ground conductor strips coupled to the peripheral ground conductor at each end and lying in vertical alignment with the coupled and isolated conducting strips.

The step of forming input and through conductor strips typically comprises forming a central conductor and a pair of outer conductors and the method further comprises coupling the central conductor to one of the pair of outer conductors at each end and to each of the outer conductors at a midpoint along its length by forming respective bridging links on an intermediate metal layer lying between the first and second layers. The central and outer conductors are typically spaced apart such that they lie either side of coupled and isolated conductor strips of the Lange coupler The method normally further comprises coupling the input and through conductor strips to the input and through ports by forming respective conducting links on an intermediate metal layer.

The first, intermediate and second metal layers are typically top, intermediate and bottom metallisation layers of a semiconductor fabrication process.

Examples of the invention will now be described in detail with reference to the accompanying drawings, in which:

FIG. 1 shows a plan view of a Lange coupler according to the invention;

FIGS. 2*a*-2*e* show in detail how the Lange coupler is fabricated; and

Figure 3:
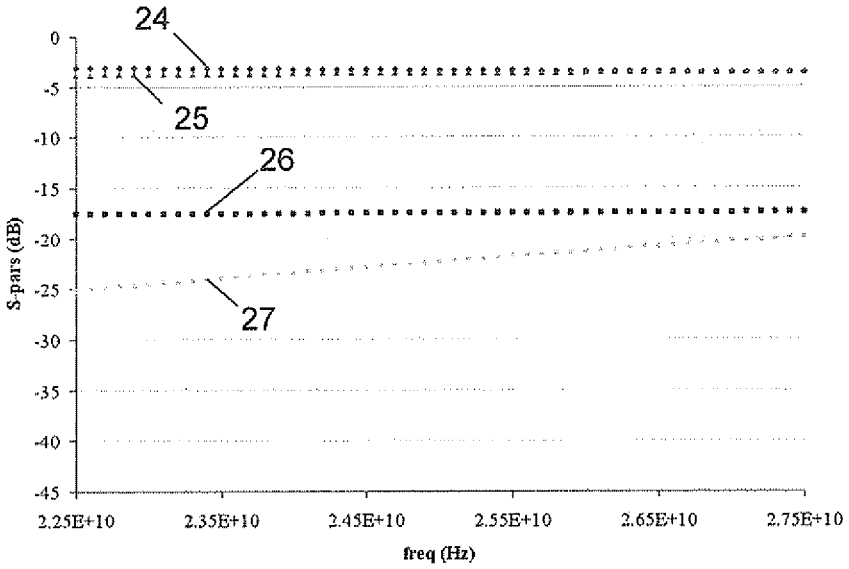
Figure 3:
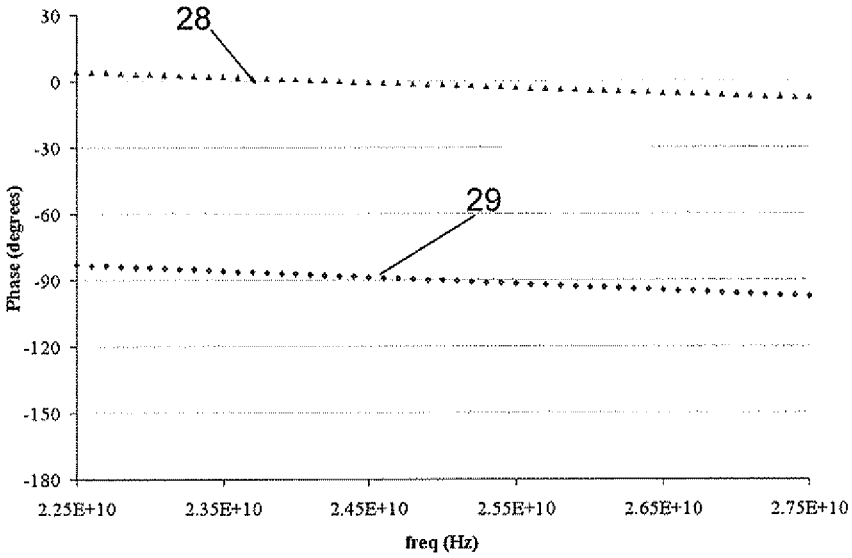

FIG. 3 shows graphs of how S-parameters and phase vary with frequency.

In FIG. 1, a Lange coupler formed on three metal layers is shown. The metal layers are usually the top, intermediate and bottom layers resulting from a semiconductor process and the Lange coupler is formed on a semiconductor substrate by suitable patterning of these metal layers. A peripheral ground conductor 1 is formed in a top metal layer along with input and through conductor strips, which are coupled to the input 2 and through 3 ports of the Lange coupler. Together, the input and through conductor strips comprise a central conductor strip 4 and outer conductor strips 5, 6.

A first end of the central conductor strip 4 and a first end of the outer conductor strip 5 are coupled by vias to a metal conducting link 7, connected to the input port 2, on an intermediate metal layer. Similarly a second end of the central conductor strip 4 and a first end of the outer conductor strip 6 are coupled by vias to a metal conducting link 8, connected to the through port 3, on the intermediate metal layer. A bridging link 13 on the intermediate metal layer is coupled to the second ends of the outer conductor strips 5, 6 and to the midpoint of the central conductor strip 4.

First 9 and second 10 ground conductor strips extend from the peripheral ground conductor 1 to free ends, which are coupled back to the peripheral ground conductor 1 by way of vias and respective bridging links 11, 12 on the intermediate metal layer.

Isolated 14 and coupled 15 conductor strips are arranged on the bottom metal layer directly underneath the first 9 and second 10 ground conductor strips. The isolated 14 and coupled 15 conductor strips and the first 9 and second 10 ground conductor strips together form microstrip lines. The isolated 14 and coupled 15 conductor strips are coupled together at each end by bridging links 16, 17 on the intermediate metal layer coupled to the isolated 14 and coupled 15 conductor strips by vias. Metal conducting links 18, 19 on the bottom metal layer connect the isolated 14 and coupled 15 conductor strips to isolated 20 and coupled 21 ports respectively.

As can be seen, the central 4, first 5 and second 6 conductor strips are spaced apart to lie either side of the isolated 14 and coupled 15 conductor strips. Thus, the input, through, isolated 14 and coupled 15 conductor strips are effectively interdigitated (albeit on different metal layers).

Figure 2B:
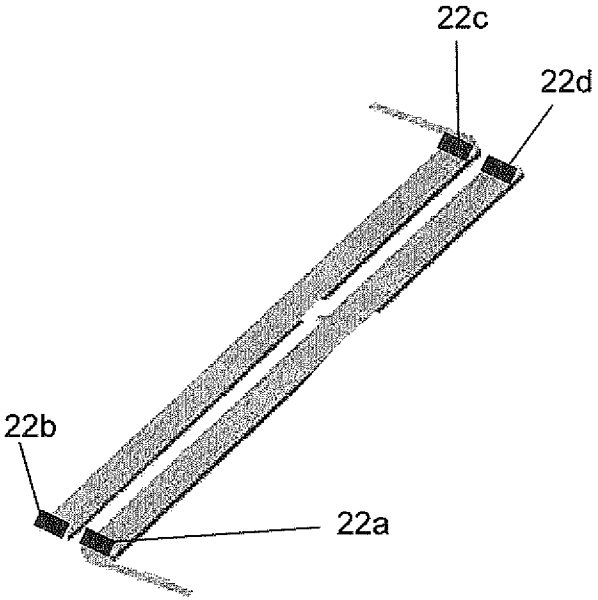
Figure 2A:
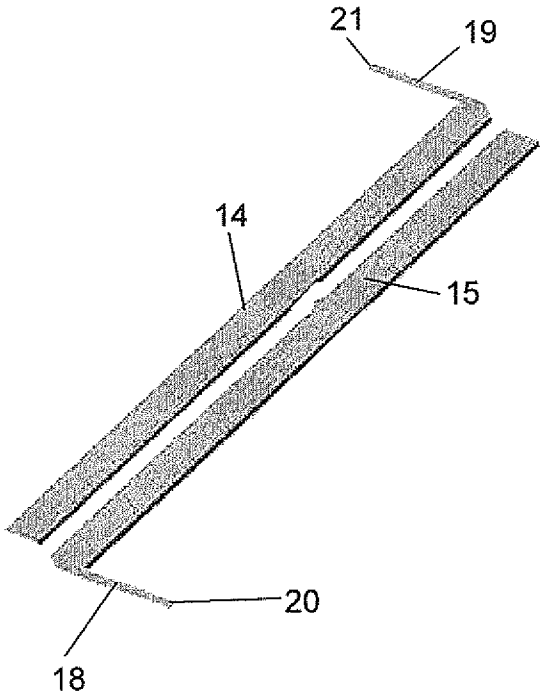

The fabrication process for the Lange coupler of FIG. 1 is shown in detail in FIGS. 2*a* to 2*e*. The reference numbers for all elements are not so provided in all of FIGS. 2*a* to 2*e* to avoid obscuring the drawings. In FIG. 2*a*, a bottom metallisation layer is deposited on a semiconductor substrate using conventional processing techniques. The bottom metallisation layer is patterned to form the isolated 14 and coupled 15 conductor strips and the metal conducting links 18,19 that connect the isolated 14 and coupled 15 conductor strips to the isolated 20 and coupled 21 ports.

In the next stage, shown in FIG. 2*b*, vias 22*a*, 22*b*, 22*c*, 22*d* are formed at each end of each of the isolated 14 and coupled 15 conductor strips. The vias 22*a*, 22*b*, 22*c*, 22*d* connect the isolated 14 and coupled 15 conductor strips together by way of bridging links 16, 17 formed by suitable patterning of an intermediate metal layer as shown in FIG. 2*c*.

Also formed in the intermediate metal layer are the bridging links 11, 12 and 13, which couple the free ends of the first 9 and second 10 ground conductor strips to the peripheral ground conductor 1 and the second ends of the outer conductor strips 5, 6 to the midpoint of the central conductor strip 4. Metal conducting links 7, 8 are also formed in the intermediate metal layer.

Figure 2D:
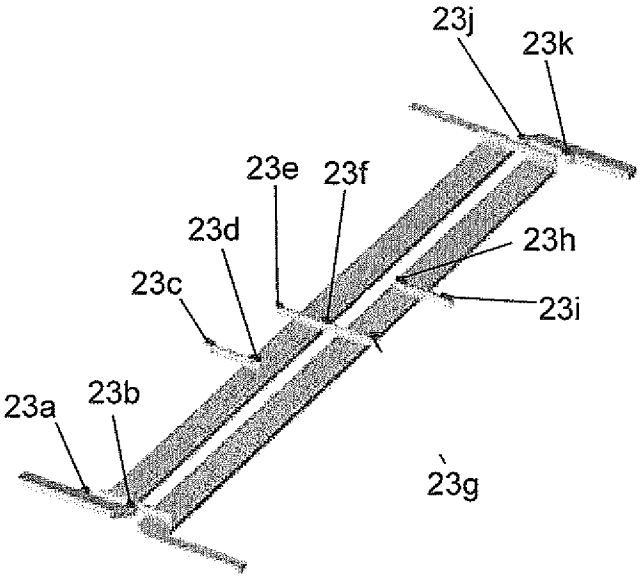
Figure 2C:
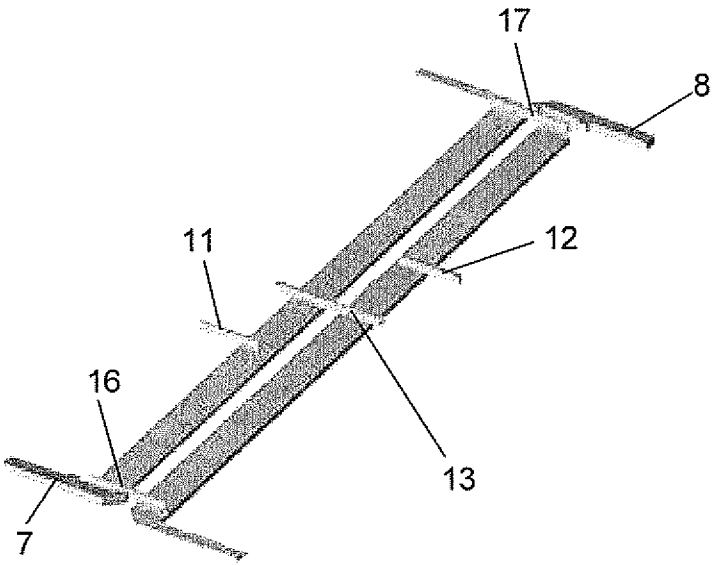

In the next step, shown in FIG. 2*d*, vias 23*a* to 23*k* are formed to couple the intermediate metal layer as required to the top metal layer. Vias 23*a*, 23*b* couple the metal conducting link 7 to the central conductor strip 4 and outer conductor strip 5. Vias 23*j*, 23*k* couple the metal conducting link 8 to the central conductor strip 4 and outer conductor strip 6. Vias 23 23*e*, 23*f*, 23*g* couple the second ends of the outer conductor strips 5, 6 to the midpoint of the central conductor strip 4. Vias 23*c*, 23*d* couple the free end of the first ground conductor strip 9 to the peripheral ground conductor 1, and vias 23*h*, 23*i* couple the free end of the second ground conductor strip 10 to the peripheral ground conductor 1.

Figure 2E:
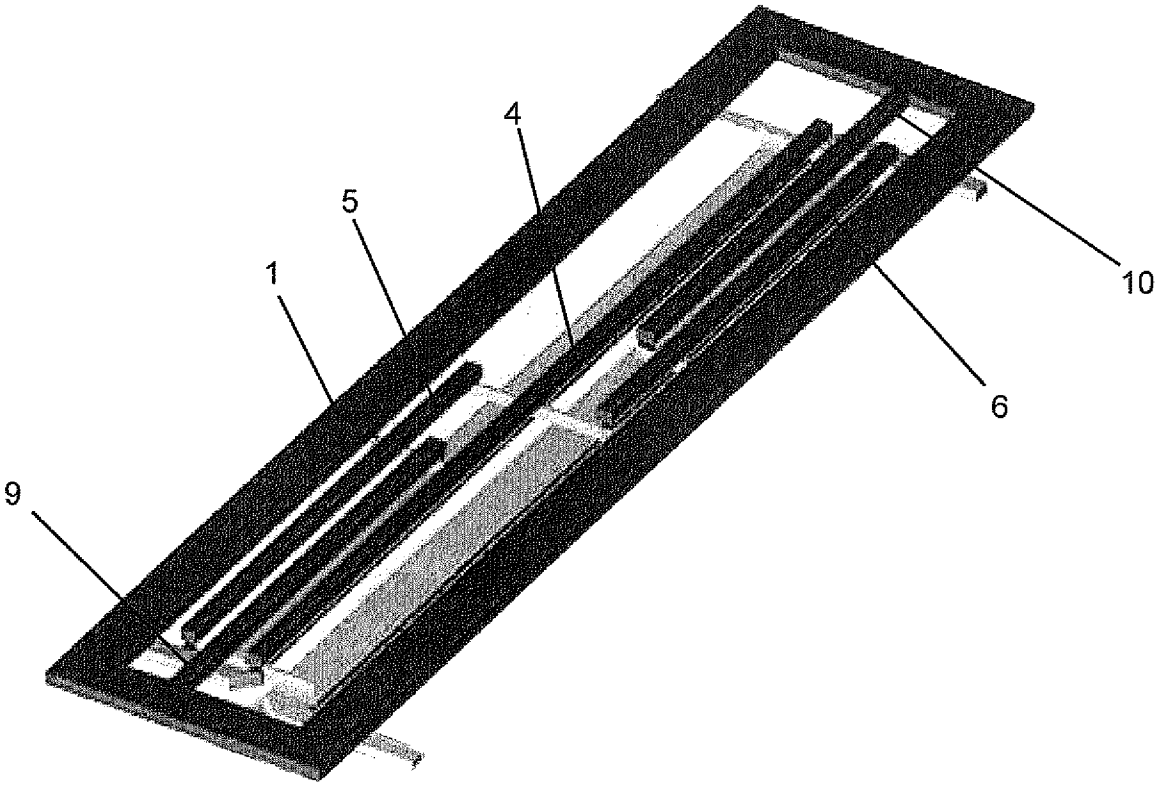

In the final step, shown in FIG. 2*e*, the top metal layer is deposited in a pattern to form the peripheral ground conductor 1, central 4 and outer 5,6 conductor strips, and the first and second ground conductor strips 9, 10.

FIG. 3 shows the performance characteristics derived by computer simulation of a 3 dB Lange coupler fabricated as shown in FIGS. 1 and 2*a* to 2*e*. In the upper graph of FIG. 3, the variation of S-parameters with frequency is shown. As can be seen from traces 24 and 25, the coupling from the input to the through (trace 24) and coupled (trace 25) ports is equal to −3 dB±0.2 dB between 22.5 and 27.5 GHz. The coupling to the isolated port (trace 26) is equal to around −17.5 dB between the same frequencies. Trace 27 shows the return loss or reflection coefficient, which as can be seen is between around −25 to −20 dB over the frequency range 22.5 to 27.5 GHz.

The lower graph in FIG. 3 shows that the phase shift between the input and coupled ports (trace 28) is around 0° between 22.5 and 27.5 GHz, whereas the phase shift between the input and through ports (trace 29) is around 90° between the same frequencies.

There are several parameters in the design of Lange coupler shown in FIG. 1 that allow tuning of odd and even mode impedance characteristics, representing an improvement over the classical Lange coupler with a full ground plane discussed above. For example, the widths of the isolated 14 and coupled 15 conductor strips can be different from the widths of the central 4 and outer 5, 6 conductor strips to optimise the Lange coupler. In particular, the widths of the isolated 14 and coupled 15 conductor strips may be enlarged to provide a portion facing the central 4 and outer 5, 6 conductor strips. In addition, the lengths of ground conductor strips 9, 10 can be selected to tune the coupling (typically, reducing their length increases the coupling from the input to the coupled port). The spacing between the peripheral ground conductor 1 and isolated 14 and coupled 15 conductor strips can be selected to tune the coupling (coupling increases when the spacing increases). Furthermore, the width of the peripheral ground conductor strip 1 can be selected to optimise the coupling and $Z_{oo}$ and $Z_{oe}$ values.

As in a conventional Lange coupler, the length of central conductor strip 4 is selected to equal a quarter wavelength at the frequency of desired operation to produce a 90° phase shift between the input and through ports. The lengths of the isolated 14 and coupled 15 conductor strips are also selected to equal a quarter wavelength at the frequency of desired operation. The lengths of the outer conductor strips 5, 6 are selected to be half the length of the central conductor strip 4. The dimensions of a Lange coupler fabricated in accordance with the invention can be varied to suit a variety of frequencies, typically ranging from RF wavelengths into terahertz wavelengths. The results shown in FIG. 3 were obtained from a Lange coupler tuned to 25 GHz, with a length of central conductor strip equal to 1.1 mm and conductor strip widths varying between 10 and 30 μm.

A Lange coupler fabricated in accordance with the invention has reduced losses when compared with prior Lange couplers fabricated using semiconductor processing techniques. The Lange coupler according to the invention may also be tuned to operate at a lower frequency and fabricated to be fully compliant with advanced IC process design rules. It is possible to control the performance parameters more tightly than with LTCC and laminate processes, leading to lower dispersion, which is crucial for this kind of device.

Other variations to the disclosed embodiments can be understood and effected by those skilled in the art in practising the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A Lange coupler comprising:

input and through conductor strips coupled respectively to input and through ports of the Lange coupler, a central conductor strip, with the input and through conductor strips on opposite sides of the central conductor strip thereby defining a pair of outer conductors, with one end of the input conductor strip connected to one end of the central conductor strip and with one end of the through conductor strip connected to another end of the central conductor strip, wherein the central conductor strip is also connected to other ends of the input and through conductor strips at a midpoint along its length;

an unbroken peripheral ground conductor surrounding the input and through conductor strips, the peripheral ground conductor and input and through conductor strips being arranged on a first metal layer;

first and second ground conductor strips coupled to the peripheral ground conductor at each end and interposed between the central conductor strip and a respective one of the pair of outer conductors; and coupled and isolated conductor strips arranged on a second metal layer, arranged on opposite lateral sides of the central conductor strip.

2. A Lange coupler according to claim 1, wherein a third metal layer is an intermediate metal layer between the first and second metal layers.

3. A Lange coupler according to claim 1, wherein the central conductor strip is coupled to the pair of outer conductors at its ends and at its midpoint by respective bridging links on a third metal layer.

4. A Lange coupler according to claim 3, wherein the input and through conductor strips are coupled to the input and through ports by respective conducting links on the third metal layer.

5. A Lange coupler according to claim 3, wherein each of the first and second ground conductor strips has a free end coupled to the peripheral ground conductor by a conducting link on the third metal layer.

6. A semiconductor substrate comprising a Lange coupler according to claim 1.

7. A semiconductor substrate comprising a Langer coupler according to claim 2 wherein the first, intermediate and second metal layers are top, intermediate and bottom metallization layers of the semiconductor substrate.

8. A method of fabricating a Lange coupler, the method comprising:

forming, on a first metal layer, input and through conductor strips and a central conductor strip, with the input and through conductor strips on opposite sides of the central conductor strip thereby defining a pair of outer conductors, an unbroken peripheral ground conductor surrounding the input and through conductor strips, and first and second ground conductor strips coupled to the peripheral ground conductor at each end and interposed between the central conductor strip and a respective one of the pair of outer conductors;

using an intermediate metal layer, connecting one end of the input conductor strip to one end of the central conductor strip and connecting one end of the through conductor strip to another end of the central conductor strip, and connecting the central conductor strip to other ends of the input and through conductor strips at a midpoint along its length; and forming coupled and isolated conducting strips on a second metal layer, the coupled and isolated conducting strips arranged on opposite lateral sides of the central conductor strip.

9. A method according to claim 8, wherein the first and second ground conductor strips are in vertical alignment with the coupled and isolated conducting strips.

10. A method according to claim 8, further comprising coupling the input and through conductor strips to the input and through ports by forming respective conducting links on the intermediate metal layer.

11. The Lange coupler according to claim 1, wherein the central conductor strip is connected to the other ends of the input and through conductor strips at the midpoint along its length via the pair of outer conductors, and the peripheral ground conductor extends laterally around the input and through conductor strips along a direction of a common plane.

12. The Lange coupler according to claim 1, wherein the coupled and isolated conductor strips are electrically coupled to coupled and isolated ports of the Lange coupler, respectively.

13. The Lange coupler according to claim 1, wherein the peripheral ground conductor, and the input and through conductor strips are further arranged on a first surface of the first metal layer.

14. The method according to claim 8, wherein forming the central conductor strip includes connecting the central conductor strip to the other ends of the input and through conductor strips at the midpoint along its length via the pair of outer conductors.

15. The method according to claim 8, wherein forming the input and through conductor strips and the peripheral ground conductor includes forming the input and through conductor strips and the peripheral ground conductor on a common surface of the first metal layer.

16. The method according to claim 8, wherein forming the peripheral ground conductor and the input and through conductor strips includes forming the peripheral ground conductor and the input and through conductor strips in a common plane.

* * * * *